US008328535B2

(12) United States Patent
Anschel et al.

(10) Patent No.: US 8,328,535 B2
(45) Date of Patent: Dec. 11, 2012

(54) DIFFUSER RESTRAINT SYSTEM AND METHOD

(75) Inventors: Paul Anschel, Asheville, NC (US); Michael Bucking, Arden, NC (US); Robert Lancaster, Indianapolis, IN (US)

(73) Assignee: BorgWarner Inc., Auburn Hills, MI (US)

( * ) Notice: Subject to any disclaimer, the term of this patent is extended or adjusted under 35 U.S.C. 154(b) by 1102 days.

(21) Appl. No.: 12/027,137

(22) Filed: Feb. 6, 2008

(65) Prior Publication Data

US 2008/0193288 A1 Aug. 14, 2008

Related U.S. Application Data

(60) Provisional application No. 60/889,865, filed on Feb. 14, 2007.

(51) Int. Cl.
*F04B 17/00* (2006.01)
*F04B 35/00* (2006.01)

(52) U.S. Cl. ..... 417/407; 415/208.4; 415/214.1

(58) Field of Classification Search ..... 417/407; 415/208.3, 208.4, 211.1, 214.1
See application file for complete search history.

(56) References Cited

U.S. PATENT DOCUMENTS

| | | | | |
|---|---|---|---|---|
| 1,047,663 | A * | 12/1912 | Lawaczeck | 415/208.3 |
| 2,844,001 | A | 7/1958 | Alford | |
| 3,719,430 | A | 3/1973 | Blair et al. | |
| 3,936,223 | A | 2/1976 | Baghdadi | |
| 3,997,281 | A | 12/1976 | Atkinson | |
| 4,354,802 | A | 10/1982 | Nishida et al. | |
| 4,705,463 | A | 11/1987 | Joco | |
| 4,770,605 | A * | 9/1988 | Nakatomi | 415/148 |
| 4,815,935 | A | 3/1989 | Gottemoller | |
| 5,277,541 | A | 1/1994 | Palmer | |
| 5,399,064 | A | 3/1995 | Church et al. | |
| 6,164,931 | A | 12/2000 | Norton et al. | |
| 6,168,375 | B1 * | 1/2001 | LaRue et al. | 415/146 |
| 6,925,805 | B2 * | 8/2005 | Koch et al. | 60/602 |
| 2002/0134441 | A1 * | 9/2002 | Kusumoto et al. | 137/625.3 |
| 2007/0196206 | A1 * | 8/2007 | Martin et al. | 415/191 |

* cited by examiner

*Primary Examiner* — Devon Kramer
*Assistant Examiner* — Ryan Gatzemeyer
(74) *Attorney, Agent, or Firm* — William G. Anderson; Stephan A. Pendorf; Patent Central LLC

(57) ABSTRACT

A restraint system (300, 300', 500) for a vaned diffuser (225) of a turbocharger (100) or other fluid boosting device is provided that can reduce or eliminate losses. The system (300, 300', 500) uses a structure to provide both a pressure load on the vaned diffuser (225) and a seal for the vaned diffuser (225). The structure can be a fluoroelastomer O-ring (350, 350', 550). The O-ring (350, 350', 550) can be positioned at least partially in a channel (325, 325', 525) formed in at least one of the diffuser ring (206, 206'), the compressor housing (103) and the center housing (102).

16 Claims, 8 Drawing Sheets

DIFFUSER RESTRAINT SYSTEM AND METHOD

CROSS REFERENCE TO RELATED APPLICATIONS

This application is related to and claims priority in, U.S. Provisional Application Ser. No. 60/889,865, filed Feb. 14, 2007, the disclosures of which are incorporated herein by reference.

FIELD OF THE INVENTION

This invention is directed to a turbocharging or other fluid boosting system, and more particularly to a vaned diffuser of the turbocharger.

BACKGROUND OF THE INVENTION

Turbochargers are widely used in internal combustion engines to increase engine power and efficiency, particularly in the large diesel engines of highway trucks and marine engines. It is particularly advantageous in these types of engines to use turbochargers that are designed to provide a very high pressure ratio (the differential pressure across the compressor), compared, for example, to turbochargers typically used in smaller passenger engines. The use of a turbocharger permits selection of a power plant that develops a required number of horsepower from a smaller and lighter engine. The use of a lighter engine has the desirable effect of decreasing the total mass of the vehicle, and the reduced envelope of a smaller engine may be used to enhance the aerodynamics of the vehicle and thus reduce drag. Both of these factors enhance fuel economy and increase performance. In addition, the use of a turbocharger permits more complete combustion of the fuel delivered to the engine, which reduces hydrocarbon and $NO_x$ emissions, thereby contributing to the highly desirable goal of a cleaner atmosphere. Recently, turbochargers have also become increasingly popular for use in smaller, passenger car engines.

Turbochargers generally comprise a turbine housing that directs exhaust gases from an exhaust inlet to an exhaust outlet across a turbine rotor. The turbine rotor drives a shaft journaled in a bearing housing section. A compressor rotor is driven on the other end of the shaft, which provides high-velocity air to a diffuser. The general design and function of turbochargers is described in detail in the prior art, for example, U.S. Pat. Nos. 4,705,463; 5,399,064; and 6,164,931, the disclosures of which are incorporated herein in their respective entireties by reference.

In a radial-flow or centrifugal turbocharger, the compressor rotor receives and pressurizes the inlet gas. The compressor rotor discharges the gas with high tangential and radial components of velocity. The gas flows over a diffuser, in which the kinetic energy, or velocity head, is converted to a static pressure by deceleration or diffusion of the flow, and the temperature and pressure of the gas are increased. The increased temperature improves combustion efficiency, while the increased static pressure at the engine inlet may be used to increase the mass of air/fuel mixture in the cylinder, and/or to improve the air:fuel ratio.

The design of turbocharger compressors is a highly refined art. The shape, curvature, and surface finish of the compressor rotor, compressor housing, and diffuser are designed to produce maximum pressure boost across the desired range of operating conditions. When very high pressure ratios are required, as in the case of large commercial diesel engines, vaned diffusers are generally preferred over vaneless diffusers because they provide a higher maximum pressure ratio and increased efficiency, albeit frequently at the cost of a reduced map width, as depicted on a compressor map well known in the art as showing the relationship between pressure ratio and volume or mass flow rate.

The design of the diffuser is critical to achieving efficient turbocharger operation over a usefully wide range of engine operating conditions. While it is relatively straightforward to design a diffuser for constant inlet and outlet conditions, variations in the flow rate, and the nature of the flow increase the difficulty of providing a satisfactory diffuser for a useful range of operating conditions. Design parameters for compressors have been refined to the extent that a change of the order of 0.5-1.0% in efficiency is significant within the art. A general rule of thumb is that each one percent improvement in the efficiency of the compressor produces a one-third percent improvement in the brake specific fuel consumption (BSFC) of a diesel engine.

The vanes of a vaned diffuser define channels into which high velocity gas from the compressor is received, and through which the gas is decelerated in order to convert its kinetic energy into a static pressure. Circumferentially spaced guide vanes provide passages that expand radially in area to diffuse the flow. Because the gas flow characteristics vary with operating conditions, a high-quality surface finish and the angle of attack of the vanes are critical parameters in the design of an efficient vaned diffuser. The cross-section and shape of the vanes of a vaned diffuser are also important design parameters. Wedge-shaped, straight-sided blades, referred to as straight island type, provide a high pressure ratio and high efficiency at the expense of operating range. On the other hand, curvilinear cross-section blades permits flow straightening in the diffuser, as disclosed in U.S. Pat. No. 2,844,001. Vanes that have an aerofoil cross-section are also known in the art, as are vanes that are divided along their length, in which each portion is optionally radially offset. For smooth and uniform exit flow from the diffuser, thin edged vanes are desirable. The width of the diffuser is also an important design parameter. Therefore, in order to implement the best designs and to reap their intended benefits, it is necessary that the vanes of the diffuser are manufactured to very close tolerances. The typical design parameters for vaned diffusers are disclosed in the prior art, for example, in U.S. Pat. Nos. 2,844,001; 1,047,663; 3,936,223; 3,997,281; 3,719,430; 4,815,935; and 5,277,541, the disclosures of which are incorporated herein in their entireties by reference.

Vaned diffusers are constructed as a separate component of the compressor housing, and are typically shaped in the form of an annular ring designed to fit against a backplate or axial wall surface. Clearance gaps exist between the top of the vanes and the opposing diffuser wall due to machining tolerances. Additionally, the compressor housing is known to expand or move axially away from the backplate wall under turbocharger operating temperatures and pressures, which can further increase gaps. The contemporary vaned diffusers utilize an annular wave spring in order to provide constant pressure loading during compressor operating temperatures and pressures to ensure that the vanes on the diffuser ring remain in contact with the opposing wall, such as the backplate wall. An O-ring sealing structure must then be employed to reduce or eliminate any losses due to gaps formed between the diffuser ring and the compressor housing or center housing.

An example of a contemporary vaned diffuser is shown in U.S. Pat. No. 4,354,802 to Nishida. The Nishida vaned diffuser, as shown in FIG. 1, does not use either a biasing means or a sealing structure. The turbocharger 1 has a plurality of compressor vanes 2 positioned along a diffuser ring 4 within a diffuser space 5. The diffuser space 5 is defined by a single housing 7. The Nishida vaned diffuser suffers from the drawback of losses due to leakage between the vanes 2 and the housing wall 7 and between the diffuser ring 4 and the housing wall 7 with any thermal expansion of the diffuser space 5.

An example of another contemporary vaned diffuser is shown in U.S. Pat. No. 6,168,375 to LaRue. The LaRue vaned diffuser, as shown in FIG. 2, is spring-loaded with a flat wave spring and sealed with a sealing structure. The turbocharger 10 incorporates a compressor housing 12 having a volute 14 formed therein for receiving pressurized air through intake 18 from an air compressor impeller 16 rotatably disposed within the compressor housing 12. A vaned diffuser 20 is in the shape of an annular ring and is disposed within the compressor housing 12. The vaned diffuser 20 is positioned within a diffuser channel that is formed within an axially-facing surface of a compressor housing backplate 24. The vaned diffuser 20 comprises a plurality of vanes 26 that each project outwardly a distance away from an axially-facing vane diffuser surface. The vaned diffuser 20 has a tapered axially-facing surface moving radially from the impeller 16 to the volute 14 and a taper on a leading edge 30 of a vaneless section of the vane diffuser, as well as a taper on a trailing edge 32 of the vanes 26.

The LaRue turbocharger 10 has a wave spring 34 interposed between a backside surface 36 of the vaned diffuser 20 and a spring channel 38 that is formed within an axially-facing surface of the backplate 24. The spring 34 is a stamped or wire, metal, wave spring. The spring 34 is positioned between the vaned diffuser 20 and backplate 24 to impose a pressure load onto the vaned diffuser to urge it axially away from the backplate regardless of static pressure conditions within the compressor housing 12. This is done to keep the vanes 26 of the vaned diffuser 20 in contact with the compressor housing 12, at compressor housing end 28, as the compressor housing moves axially away from the backplate 24 under all turbocharger operating conditions. A pin 40 includes a first end that is placed within a pin slot 42 in the vane diffuser 20, and a second end that is placed within a pin slot 44 in the backplate 24. An annular O-ring seal 46 is disposed within a seal groove 50 formed along the axially-facing backplate surface 24, and is interposed between the vane diffuser and backplate to provide an air-tight seal therebetween. The O-ring seal 46 is intended to form and maintain an air-tight seal to prevent recirculation air flow around a backside surface of the vaned diffuser 20 even when the vaned diffuser 20 is moved away from the backplate surface 24.

The LaRue vaned diffuser suffers from the drawback of requiring two separate components or elements to perform the functions of pressure loading the vaned diffuser and sealing the vaned diffuser and backplate. The use of two such components adds complexity and cost. The use of two such components requires separate corresponding structure, e.g., spring channel 38 and seal groove 50, further adding complexity and cost.

Thus, there is a need for a system and method of restraining a vaned diffuser that reduces or eliminates performance losses. There is a further need for such a system and method that is cost effective and dependable. There is a further need for such a system and method that facilitates manufacture and assembly of the air boost device.

SUMMARY OF THE INVENTION

The exemplary embodiments of the vaned diffuser restraint system, and the turbocharger or other air boost device that uses the system, maintains a pressure load on the vaned diffuser while reducing or eliminating losses. The system can use a single structure for pressure loading and sealing that is stronger and less prone to failure, as well as more cost effective.

In one aspect of an exemplary embodiment of the present invention, a compressor section for an air boost device is provided. The compressor section comprises a compressor housing defining at least in part an impeller chamber, a diffuser and a volute; a compressor impeller mounted in the compressor housing; a diffuser ring having a plurality of compressor vanes positioned in the diffuser; and a restraint system comprising an O-ring that seals the diffuser ring and biases the diffuser ring thereby abutting the plurality of compressor vanes against an opposing wall of the diffuser.

In another aspect, a turbocharger is provided comprising a turbine housing having a turbine rotor and a turbine inlet; a compressor housing defining at least in part an impeller chamber, a diffuser and a volute; a compressor impeller mounted in the compressor housing and being operably connected to a turbine rotor for driving of the compressor impeller; a diffuser ring having a plurality of compressor vanes positioned in the diffuser; and a restraint system comprising an O-ring that seals the diffuser ring and biases the diffuser ring thereby abutting the plurality of compressor vanes against an opposing wall of the diffuser.

In another aspect, a method of manufacturing a turbocharger is provided comprising providing a compressor housing defining at least in part an impeller chamber, a diffuser and a volute; mounting a diffuser ring in the compressor housing thereby positioning a plurality of compressor vanes in the diffuser; forming an annular channel in at least one of the diffuser ring, the compressor housing and a backing wall of a center housing; and positioning an O-ring in the annular channel to seal the diffuser ring with one of the compressor housing or the backing wall and to provide a pressure load on the diffuser ring thereby abutting the plurality of compressor vanes against an opposing wall of the diffuser.

BRIEF DESCRIPTION OF THE DRAWINGS

The present invention is illustrated by way of example and not limitation in the accompanying drawings in which like reference numbers indicate similar parts, and in which.

DETAILED DESCRIPTION OF THE INVENTION

Embodiments of the invention are directed to reducing or eliminating losses in a vaned diffuser of an air boost device through use of a vaned diffuser restraint system and method. Aspects of the invention will be explained in connection with a compressor section of a turbocharger having various components including a compressor wheel and turbine rotor, but the detailed description is intended only as exemplary. Exemplary embodiments of the invention are shown in FIGS. 3-6, but the present invention is not limited to the illustrated structure or application.

Figure 1:
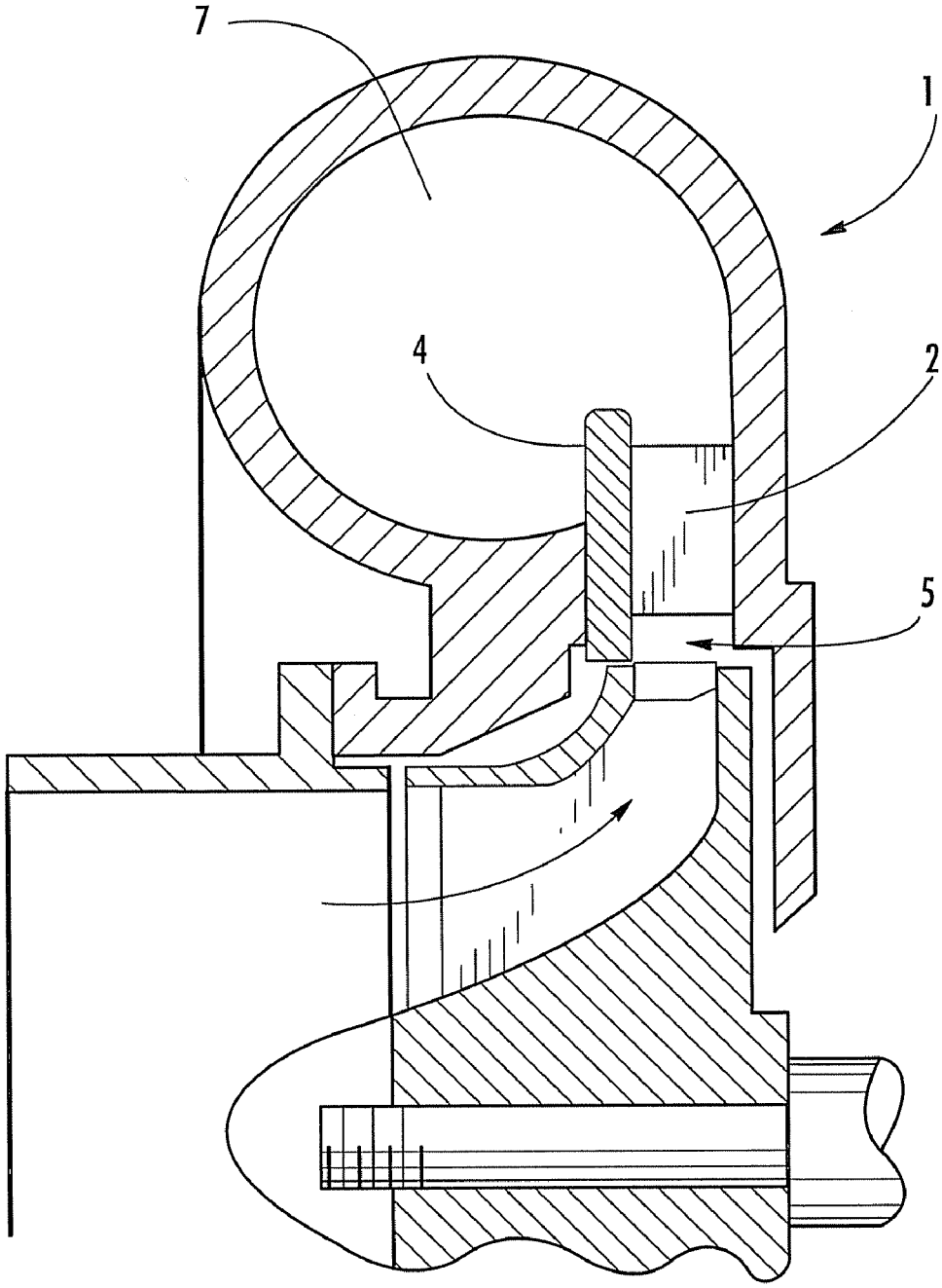
FIG. 1 (PRIOR ART)
FIG. 1 is a schematic representation of a vaned diffuser of a contemporary turbocharger system.
Figure 2:
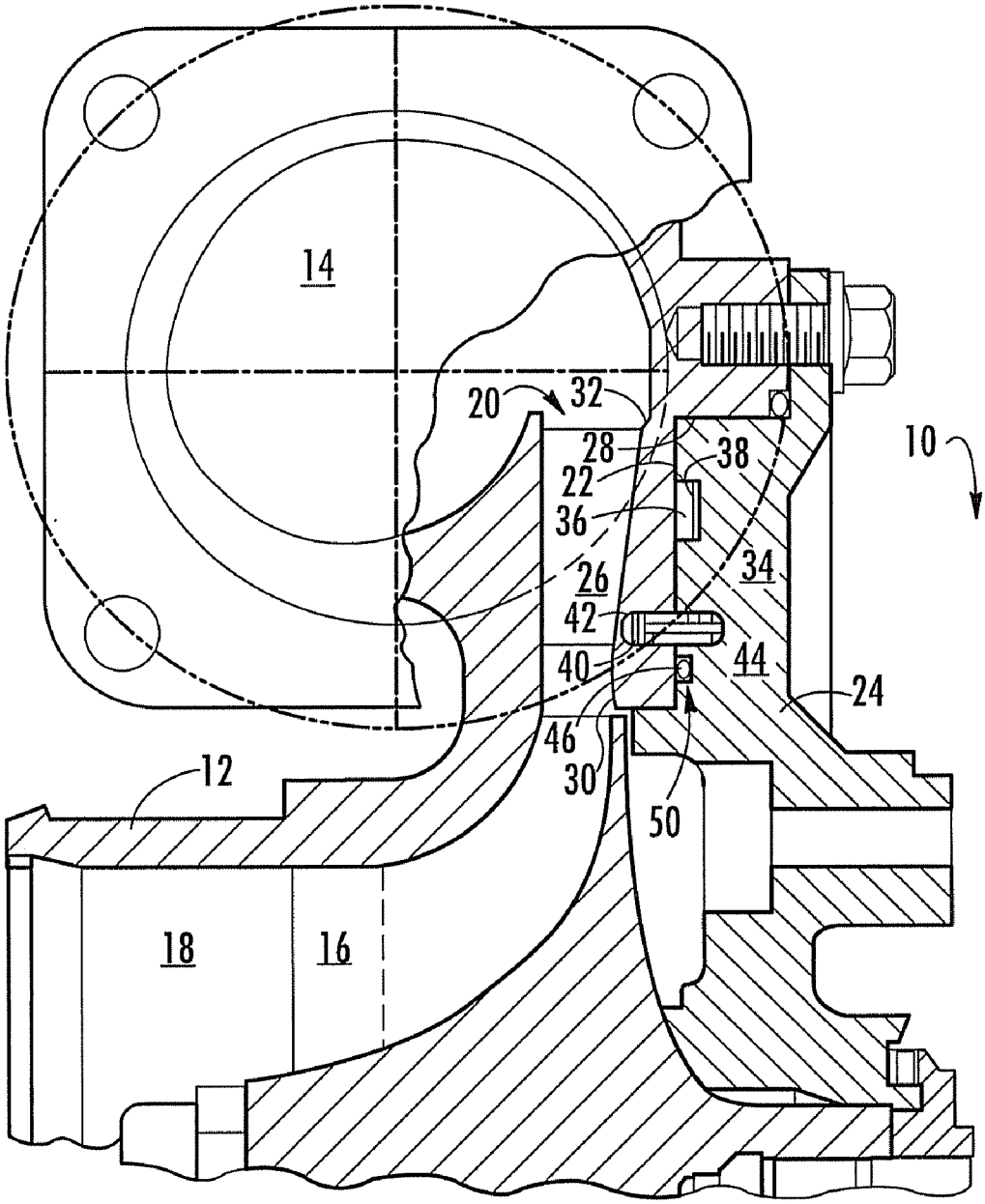
FIG. 2 (PRIOR ART)
FIG. 2 is a schematic representation of a vaned diffuser of another contemporary turbocharger system.
Figure 3:
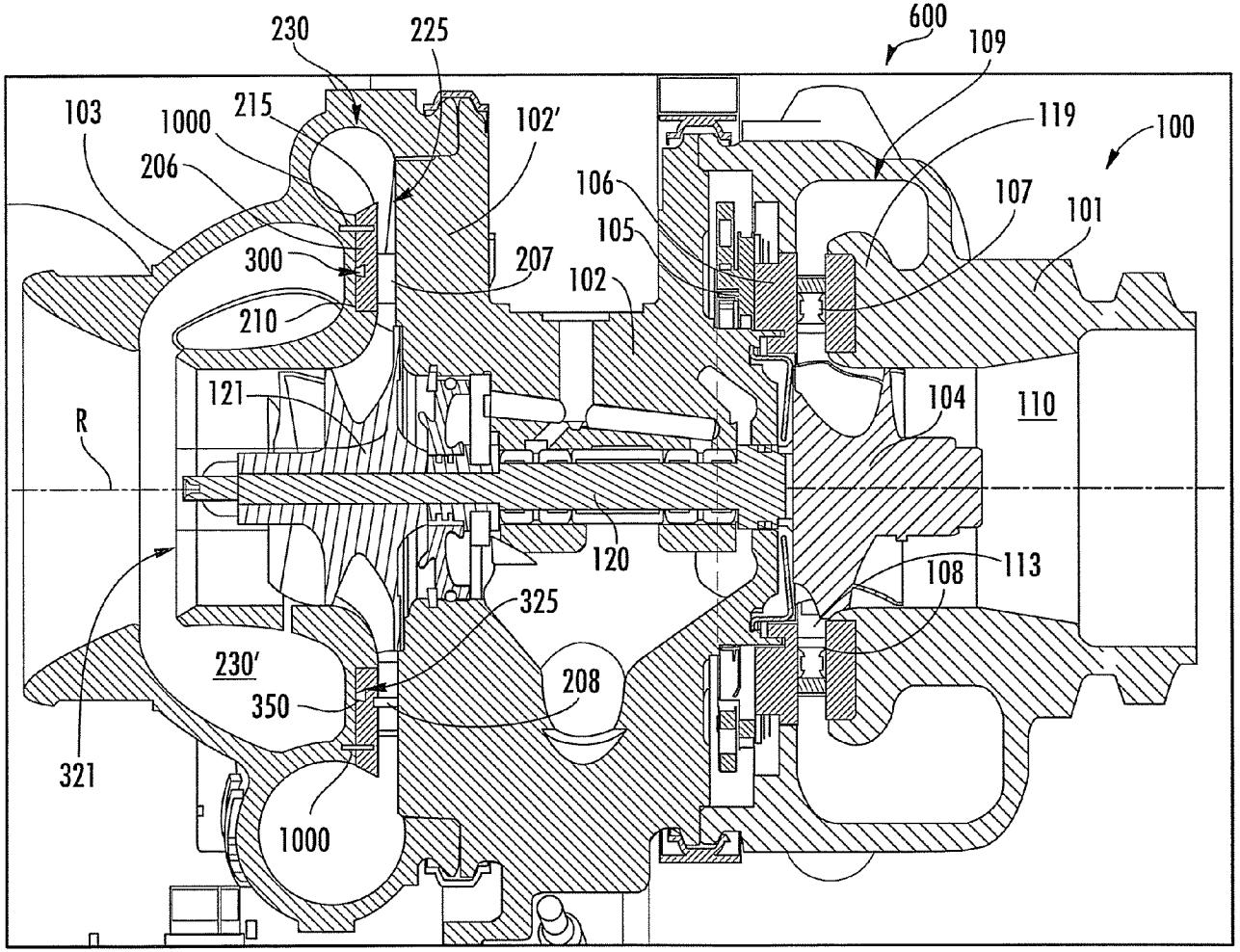
FIG. 3 is a cross-sectional view of a turbocharger having an exemplary embodiment of a vaned diffuser restraint system in accordance with the present invention.

Referring to FIG. 3, a turbocharger 100 has a turbine housing 101, a center housing 102 and a compressor housing 103 connected to each other and positioned along an axis of rotation R. The turbine housing 101 has an outer guiding grid of guide vanes 107 over the circumference of a support ring 106. The guide vanes 107 may be pivoted by pivoting shafts 108 inserted into bores of the support ring 106 so that each pair of vanes define nozzles of selectively variable cross-section according to the pivoting position of the vanes 107. This allows for a larger or smaller amount of exhaust gases to be supplied to a turbine rotor 104. The present disclosure also contemplates the use of other structures and techniques for moveably connecting the vanes 107 to the support ring 106.

The exhaust gases are provided to the guide vanes 107 and rotor 104 by a supply channel 109 having an inlet 600. The exhaust gases are discharged through a central short feed pipe 110, and the rotor 104 drives the compressor wheel, impeller or rotor 121 fastened to the shaft 120 of the wheel. The present disclosure also contemplates turbine housing 101 and center housing 102 being integrally formed with each other. Various journals, bearings and lubrication components, channels and other structure can be utilized to facilitate the transfer of the rotational movement of the turbine rotor 104 to the compressor wheel 121.

In order to control the position of the guide vanes 107, an actuation device can be provided, which controls an actuation movement of a pestle member housed therein, whose axial movement is converted into a rotational movement of an adjustment or control ring 105 situated behind the support ring 106. By this rotational movement, the guide vanes 107 may be displaced from a substantially tangential extreme position into a substantially radially extending extreme position. In this way, a larger or smaller amount of exhaust gases from a combustion motor supplied by the supply channel 109 can be fed to the turbine rotor 104, and discharged through the axial feed pipe 110.

Between the vane support ring 106 and a ring-shaped portion 115 of the turbine housing 101, there can be a relatively small vane space 113 to permit free movement of the vanes 107. The shape and dimensions of the vane space 113 can be chosen to increase the efficiency of the turbocharger 100, while allowing for thermal expansion due to the hot exhaust gases. To ensure the width of the vane space 113 and the distance of the vane support ring 106 from the opposite housing ring 115, the vane support ring 106 can have spacers formed thereon. While the exemplary embodiment of turbocharger 100 describes a variable geometry turbine, it should be understood that the present disclosure also contemplates other types of turbines driving the compressor wheel 121, with or without vanes and/or moveable vanes.

Figure 4:
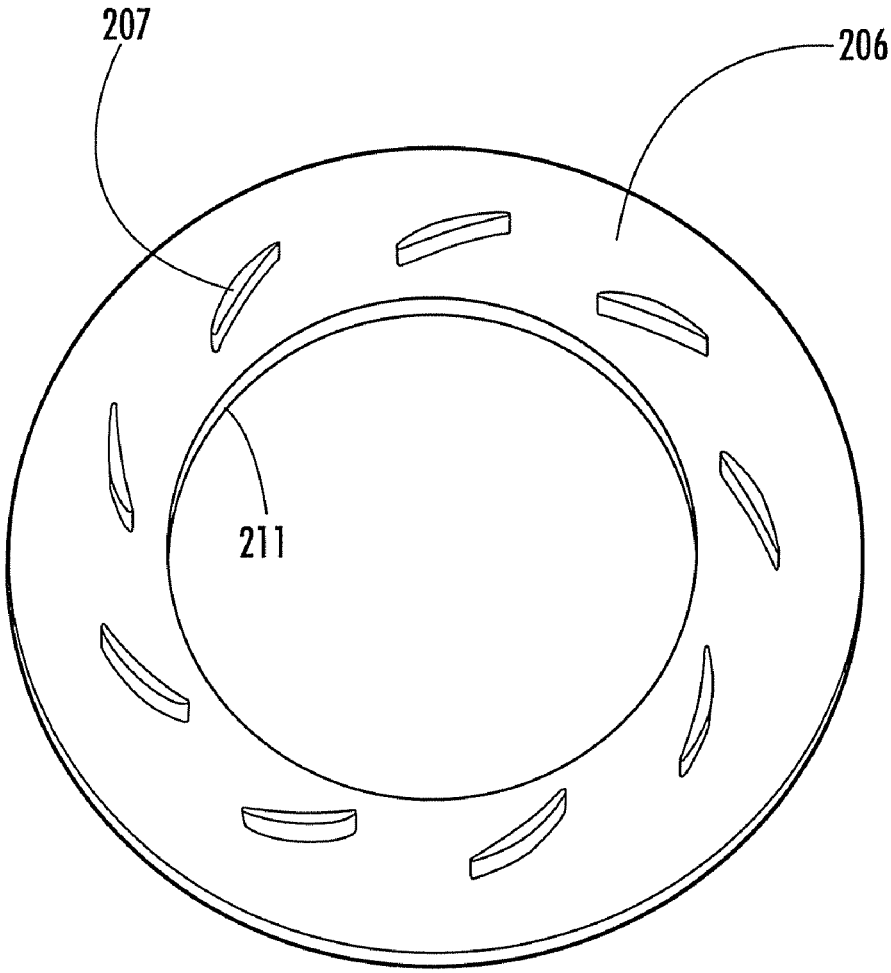
FIG. 4 is a perspective view of an exemplary embodiment of a vaned diffuser ring usable with the turbocharger of FIG. 3.
Figure 5:
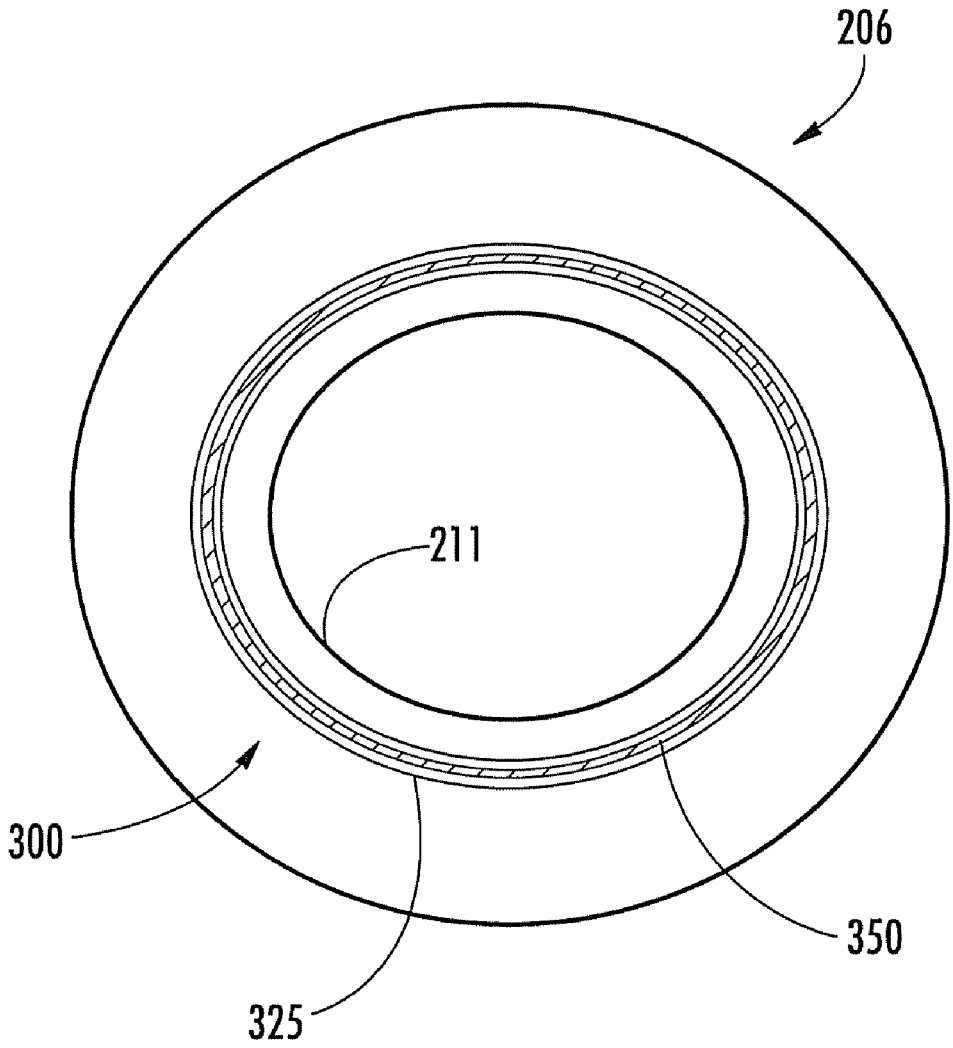
FIG. 5 is a plan view of the vaned diffuser of FIG. 4 showing the exemplary embodiment of the restraint system.

Referring additionally to FIGS. 4 and 5, turbocharger 100 has a compressor section with the compressor housing 103 defining an impeller chamber 321 for mounting of the compressor wheel or impeller 121 therein. The compressor housing 103 can also define, at least in part, a diffuser 225 and a volute 230 for increasing the pressure of the fluid. In the exemplary embodiment of FIGS. 3-5, the diffuser 225 is defined by the compressor housing 103 and a backing wall 102' of the center housing 102. The present disclosure also contemplates the use of a separate backing plate or other structure to partially define the diffuser 225. The compressor impeller 121 is in fluid communication with the diffuser 225 and volute 230 for delivery of the compressed fluid to the internal combustion engine (not shown) or other device. Turbocharger 100 has a twin volute compressor section with volutes 230 and 230', but a single volute or more than two volutes are also contemplated by the present disclosure.

The compressor section of turbocharger 100 has a diffuser ring 206 with a plurality of compressor vanes 207 operably connected thereto. In one embodiment, the compressor vanes 207 are connected to the diffuser ring 206 by posts 208. The present disclosure contemplates other structures and techniques for connecting the compressor vanes 207 to the diffuser ring 206, including welding.

In one embodiment, the compressor vanes 207 are integrally formed with the diffuser ring 206 through a machining process from solid metal, such as an aluminum alloy. In another embodiment, the compressor vanes 207 are integrally formed with the diffuser ring 206 through a casting process that may or may not include machining. A casting process that can be used for forming the diffuser ring 206 and vanes 207 is described in a co-pending and commonly owned patent application, which is U.S. Publication No. 20050039334 entitled "Method for the Manufacture of a Vaned Diffuser", the disclosure of which is incorporated herein by reference.

The present disclosure also contemplates the use of moveable compressor vanes operably connected to diffuser ring 206. The particular moveable connection, as well as the actuating or control mechanism, for the moveable compressor vanes can be chosen by one of ordinary skill in the art, including pins, linkages and the like. The movement may or may not be synchronized with movement of the turbine vanes 107.

The diffuser ring 206 can be positioned along a shoulder 210 of the compressor housing 103. Preferably, the shoulder 210 is a continuous annular shoulder 210. The shoulder 210 can be formed by various processes including machining, casting and combinations of both. In one embodiment, an inner wall 211 of the diffuser ring 206 can be press-fit around the annular shoulder 210 to facilitate the assembly process. Although the present disclosure contemplates a loose fit between the diffuser ring 206 and the shoulder 210. An outer wall 215 of the diffuser ring 206 can be tapered or otherwise shaped, e.g., curved, to correspond to the shape of volute 230. One or more pins 1000 can be operably connected to the diffuser ring 206 and another component of the turbocharger 100, such as the compressor housing 103 (as shown) or the center housing 102, to prevent rotation of the diffuser ring. The particular number, position, size and shape of the pins 1000 or other non-rotation structures can be chosen by one of ordinary skill in the art based upon a number of factors, including strength and ease of assembly.

Clearance gaps exist between the vanes 207 and the backing wall 102' of the center housing 102 due to manufacturing and/or machining tolerances. Such clearance gaps can result in performance losses where the fluid travels through the gaps rather than over the vanes 207. Additionally, during operation at elevated temperatures and pressures in the compressor section, the compressor housing 103 can move with respect to the backing wall 102'. This movement can further change the size of the gaps between the vanes 207 and the backing wall 102'.

Turbocharger 100 has a restraint system 300 that maintains a pressure load or bias on the vaned diffuser ring 206 to maintain the vanes 207 against the backing wall 102' of the center housing 102, while reducing or eliminating losses around the diffuser ring. The system 300 includes a channel 325 formed in the diffuser ring 206 with an O-ring 350 positioned therein. The O-ring 350 is preferably made from a fluoroelastomer, such as fluorocarbon. One example of such a material is VITON® made by E.I. Du Pont De Nemours & Company Corporation. The O-ring 350 can be chosen from a material having a compression set with retention of more than 90% of its original sealing force after being subjected to 100 hours in air at 150° C. The present disclosure contemplates using other high performance materials for O-ring 350, such as a perfluoroelastomer.

System 300 can maintain the pressure load or bias on the diffuser ring 206 so that any clearance gaps are eliminated and the vanes 207 do not back away from the backing wall 102' during operation, both of which would result in leakage around the vanes. The O-ring 350 also functions to seal the gap between the diffuser ring 206 and the compressor housing 103, which can change in size with operation at elevated pressure and temperature. The use of a high performance material, such as fluorocarbon, allows O-ring 350 to retain its sealing force and pressure loading capability even after long term cycling through the severe environment in the compressor section of turbocharger 100.

Figure 3A:
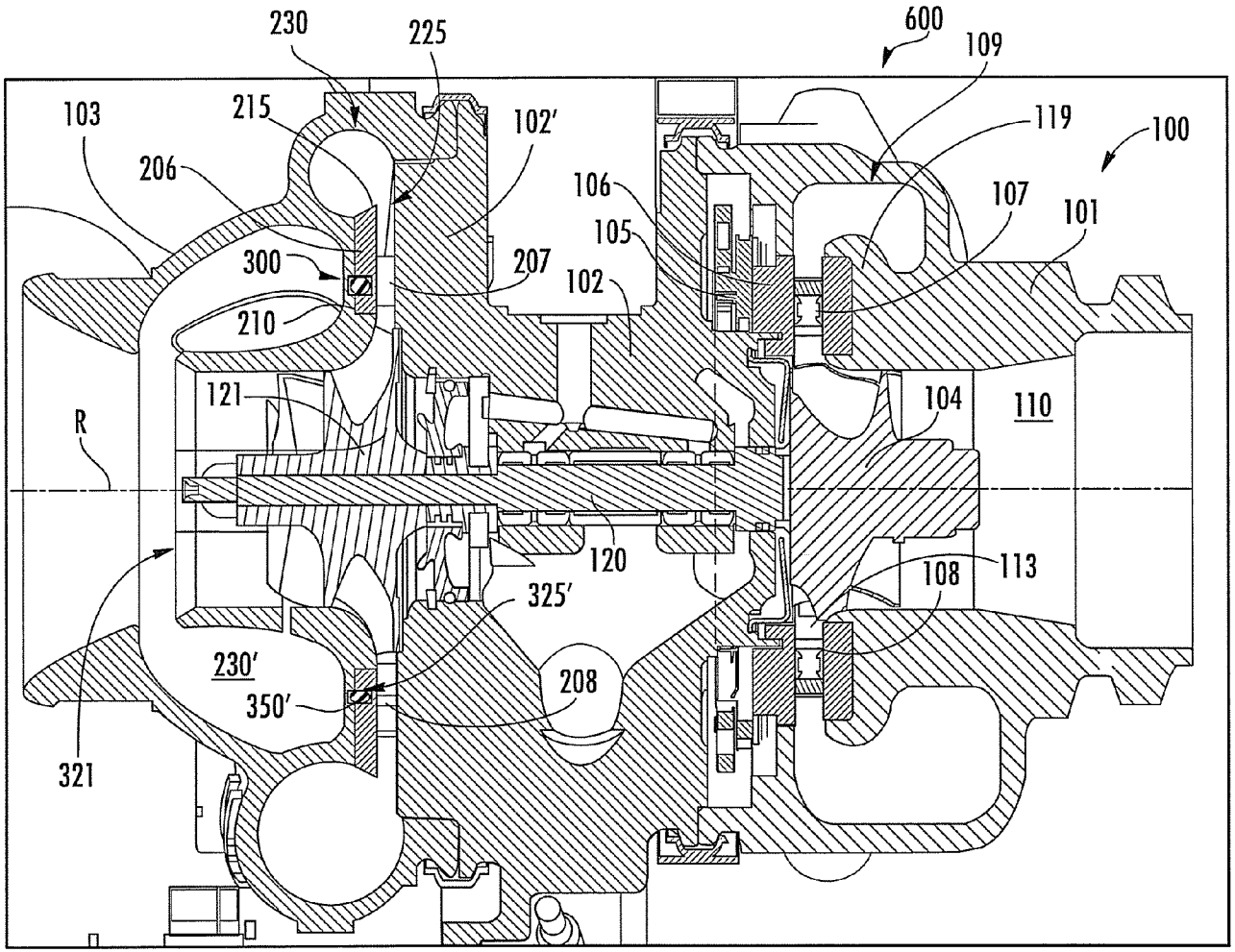
FIG. 3A is a cross-sectional view of a turbocharger having another exemplary embodiment of a vaned diffuser restraint system in accordance with the present invention.

The particular size and shape of the channel 325 and the O-ring 350 can be chosen based upon a number of factors including the turbocharger operating conditions such as elevated temperature and pressure. In one embodiment, the channel 325 has a substantially dove-tailed shape to facilitate assembly and retention of the O-ring 350 in the channel 325. This allows for retention of the O-ring 350 in the channel 325 regardless of the orientation of the compressor housing 103, such as in a blind assembly. Other shapes can also be used for channel 325, including a U-shaped channel. In the exemplary embodiment of FIGS. 3-5, the channel 325 is formed only in the diffuser ring 206. However, the present disclosure contemplates a restraint system 300' where a channel 325' is formed in both the compressor housing 103 and the diffuser ring 206, as shown in FIG. 3A. The O-ring 350' is positioned in both portions of the channel 325'. The present disclosure also contemplates the channel which holds O-ring 350 being formed in only the compressor housing 103.

Figure 4A:
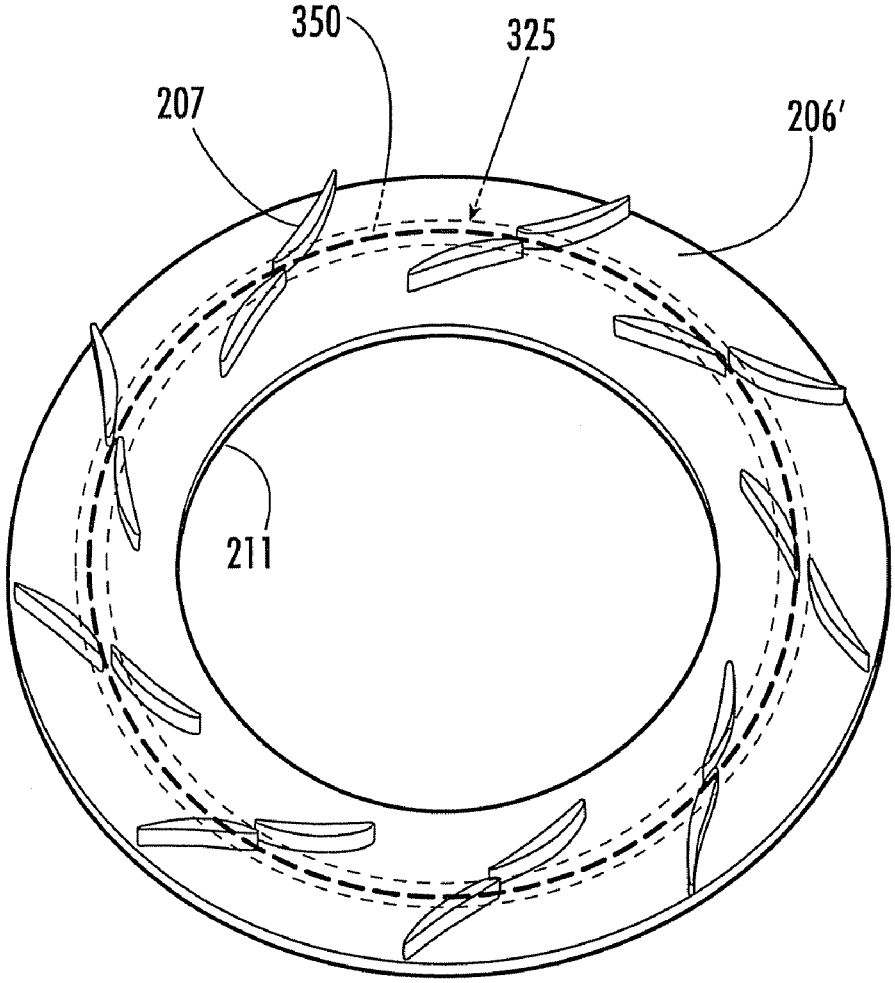
FIG. 4A is a perspective view of another exemplary embodiment of a vaned diffuser ring usable with the turbocharger of FIG. 3.

In the exemplary embodiment of FIGS. 3-5, the channel 325 is positioned along a radially inner portion of the diffuser ring 206 and is concentrically aligned with the ring. The positioning of the channel 325 and the O-ring 350 corresponds to, or is radially aligned with, a middle portion of the vanes 207 so that the pressure load or bias on the diffuser ring properly aligns the vanes against the opposing diffuser surface, such as backing wall 102'. However, the present disclosure contemplates the positioning of the channel 325 and the O-ring 350 along other portions of the diffuser ring 206. In one embodiment of the diffuser ring, where multiple annular rows of vanes are positioned along a diffuser ring 206', such as the two annular rows shown in FIG. 4A, the channel 325 and the O-ring 350 can be positioned along a middle portion of the diffuser ring or otherwise positioned to substantially equally distribute the pressure load to each of the rows of vanes 207.

Figure 6:
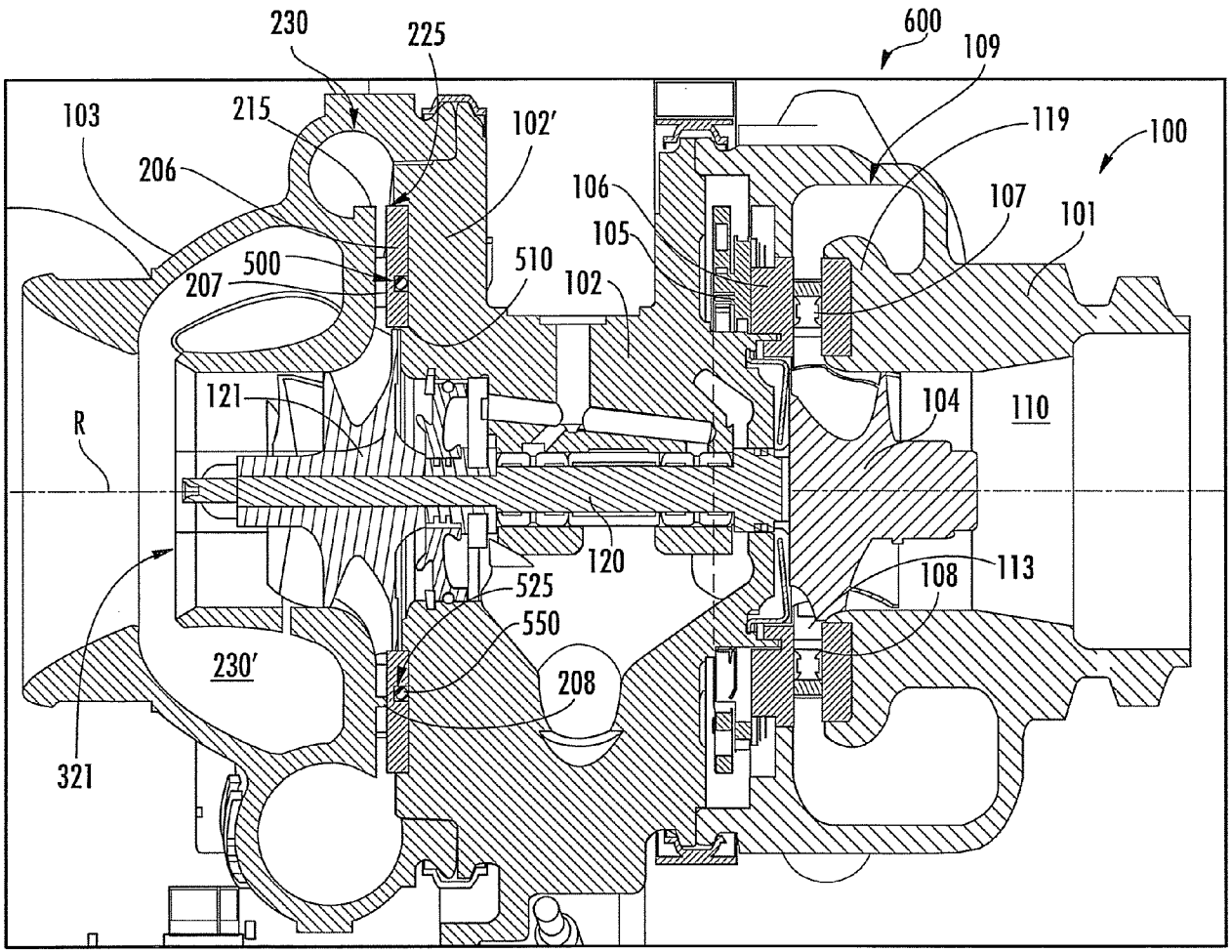
FIG. 6 is a cross-sectional view of a turbocharger having another exemplary embodiment of a vaned diffuser restraint system in accordance with the present invention.

Referring to FIG. 6, another exemplary embodiment of a vaned diffuser restraint system is shown and generally represented by reference numeral 500. The turbocharger 100 has many components similar to the previous turbochargers described above and which are similarly numbered. However, the diffuser ring 206 is positioned along the backing wall 102' of the center housing 102. Preferably, the diffuser ring 206 is positioned along a shoulder 510 of the center housing 102. More preferably, the shoulder 510 is a continuous annular shoulder. The shoulder 510 can be formed by various processes including machining, casting and combinations of both. In one embodiment, an inner wall 211 of the diffuser ring 206 (shown in FIGS. 4 and 5) can be press-fit around the annular shoulder 510 to facilitate the assembly process. Pins or other non-rotation structures, such as pins 1000 of FIG. 3, can be used with the system 500.

The restraint system 500 maintains a pressure load or bias on the vaned diffuser ring 206 to maintain the vanes 207 against the compressor housing 103, while reducing or eliminating losses around the diffuser ring. The system 500 includes a channel 525 formed in the diffuser ring 206 with an O-ring 550 positioned therein.

As described above with respect to O-ring 350, the O-ring 550 is made from a high performance material that can retain its sealing force and pressure loading capability even after long term cycling through the severe environment in the compressor section of turbocharger 100. The particular size and shape of the channel 525 and O-ring 550 can be chosen based on a number of factors including the operating temperature and pressure. The channel 525 can be formed in one or both of the diffuser ring 206 and backing wall 102'. It should be further understood that where a separate backwall plate is used in the turbocharger, the present disclosure contemplates forming the channel 525 or a portion thereof in the backwall plate. Additionally, where the turbocharger includes only compressor and turbine housings, the present disclosure contemplates forming the channel 525 or a portion thereof in at least one of the diffuser ring, the compressor housing and the turbine housing.

Turbocharger 100 provides a diffuser ring 206 that does not need to be bolted to the compressor housing 103 or center housing 102. The use of O-rings 350, 350' or 550 seals the gap between the diffuser ring 206 and the housing 102 or 103, while maintaining a bias between the vanes 207 and opposing wall. The elimination of the bolt or other rigid connection structure facilitates assembly, reduces cost and may reduce or eliminate thermal creep or bending of the diffuser ring.

While the present disclosure has been described with respect to a turbocharger system. It is also contemplated by the present disclosure that vaned diffuser restraint system 100 can be used with other types of fluid impelling or boosting devices that are subjected to inefficiencies due to clearance gaps and/or diffuser ring movement. Such other fluid impelling devices include, but are not limited to, the following: superchargers; centrifugal pumps; centrifugal fans; single-stage gas compressors; multistage gas compressors; and other kinds of devices which generally use one or more rotating elements to compress gases and/or induce fluid flow.

While the invention has been described by reference to a specific embodiment chosen for purposes of illustration, it should be apparent that numerous modifications to the structure, composition and/or method steps could be made thereto by those skilled in the art without departing from the spirit and scope of the invention.

The invention claimed is:

1. A compressor section for a fluid boosting device (100), the compressor section comprising:

a compressor housing (103) defining at least in part an impeller chamber (321), a diffuser (225) and a volute (230);

a compressor impeller (121) mounted in the compressor housing (103);

a diffuser ring (206, 206') having a plurality of compressor vanes (207) positioned in the diffuser (225); and a restraint system (300, 300', 500) that seals the diffuser ring (206, 206') and biases the diffuser ring (206, 206') thereby abutting the plurality of compressor vanes (207) against an opposing wall of the diffuser (225), the restraint system (300, 300', 500) being defined by a single O-ring (350, 350', 550).

2. The compressor section of claim 1, wherein the O-ring (350, 350', 550) is made from a fluoroelastomer.

3. The compressor section of claim 1, wherein the O-ring (350, 350', 550) is made from a fluorocarbon.

4. The compressor section of claim 1, further comprising a channel (325, 325', 525) formed in at least one of the diffuser ring (206, 206'), the compressor housing (103) and a backing wall (102') of a center housing (102), wherein the O-ring (350, 350', 550) is positioned at least partially in the channel (325, 325', 525).

5. The compressor section of claim 1, wherein the O-ring (350, 350', 550) is radially aligned with a middle portion of the plurality of compressor vanes (207).

6. The compressor section of claim 4, wherein the channel (325, 325', 525) is dove-tailed.

7. The compressor section of claim 1, further comprising a channel (325, 325', 525) formed in the diffuser ring (206, 206') on a surface opposite to the plurality of compressor vanes (207), wherein the O-ring (350, 350', 550) is positioned at least partially in the channel (325, 325', 525).

8. A turbocharger (100) comprising:

a turbine housing (101) having a turbine rotor (104) and a turbine inlet (109);

a compressor housing (103) defining at least in part an impeller chamber (321), a diffuser (225) and a volute (230);

a compressor impeller (121) mounted in the compressor housing (103) and being operably connected to a turbine rotor (104) for driving of the compressor impeller (121);

a diffuser ring (206, 206') having a plurality of compressor vanes (207) positioned in the diffuser (225); and a restraint system (300, 300', 500) that seals the diffuser ring (206, 206') and biases the diffuser ring (206, 206') thereby abutting the plurality of compressor vanes (207) against an opposing wall of the diffuser (225), the restraint system (300, 300', 500) being defined by a single O-ring (350, 350', 550).

9. The turbocharger (100) of claim 8, wherein the O-ring (350, 350', 550) is made from a fluoroelastomer.

10. The turbocharger (100) of claim 8, wherein the O-ring (350, 350', 550) is made from a fluorocarbon.

11. The turbocharger (100) of claim 8, further comprising a channel (325, 325', 525) formed in at least one of the diffuser ring (206, 206'), the compressor housing (103) and a backing wall (102') of a center housing (102), wherein the O-ring (350, 350', 550) is positioned at least partially in the channel (325, 325', 525).

12. The turbocharger (100) of claim 8, wherein the O-ring (350, 350', 550) is radially aligned with a middle portion of the plurality of compressor vanes (207).

13. The turbocharger (100) of claim 11, wherein the channel (325, 325', 525) is dove-tailed.

14. The turbocharger (100) of claim 8, further comprising a channel (325, 325', 525) formed in the diffuser ring (206, 206') on a surface opposite to the plurality of compressor vanes (207), wherein the O-ring (350, 350', 550) is positioned at least partially in the channel (325, 325', 525).

15. The compressor section of claim 1, wherein the O-ring (350, 350', 550) has a compression set with retention of more than 90% of its original sealing force after being subjected to 100 hours in air at 150° C.

16. The turbocharger (100) of claim 8, wherein the O-ring (350, 350', 550) has a compression set with retention of more than 90% of its original sealing force after being subjected to 100 hours in air at 150° C.

* * * * *